US009353432B2

(12) United States Patent
Fujita et al.

(10) Patent No.: US 9,353,432 B2
(45) Date of Patent: May 31, 2016

(54) PURE TITANIUM SHEET EXCELLENT IN BALANCE BETWEEN STAMPING FORMABILITY AND STRENGTH

(75) Inventors: Akihisa Fujita, Takasago (JP); Yoshio Itsumi, Takasago (JP); Hideto Oyama, Takasago (JP); Takeshi Kudo, Kobe (JP); Shogo Murakami, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 608 days.

(21) Appl. No.: 13/350,057

(22) Filed: Jan. 13, 2012

(65) Prior Publication Data

US 2012/0193084 A1 Aug. 2, 2012

(30) Foreign Application Priority Data

Jan. 28, 2011 (JP) ..... 2011-017109

(51) Int. Cl.
*C22F 1/18* (2006.01)
*C22C 14/00* (2006.01)
*F28F 21/08* (2006.01)

(52) U.S. Cl.
CPC ..... *C22F 1/183* (2013.01); *C22C 14/00* (2013.01); *F28F 21/086* (2013.01)

(58) Field of Classification Search
CPC ..... C22C 14/00; C22F 1/183
See application file for complete search history.

(56) References Cited

U.S. PATENT DOCUMENTS 4,714,107 A * 12/1987 Adsett ..... 165/166
2011/0017369 A1 1/2011 Shirai et al.

FOREIGN PATENT DOCUMENTS

| | | |
|---|---|---|
| JP | 60-194052 | 10/1985 |
| JP | 63-103056 | 5/1988 |
| JP | 9-216004 | 8/1997 |
| JP | 10-30160 | 2/1998 |
| JP | 2002-317234 | 10/2002 |
| JP | 2004-285457 | 10/2004 |
| JP | 2009-228092 | 10/2009 |

OTHER PUBLICATIONS

Molodov, D. A., Chr Bollmann, and G. Gottstein. "Impact of a magnetic field on the annealing behavior of cold rolled titanium." Materials Science and Engineering: A 467.1 (2007): 71-77.*
English Abstract of Miyamoto et al. (JP 63-103056) (May 7, 1988).*
English Abstract of Matsumoto et al. (JP 2004-285457) (Oct. 14, 2004).*

(Continued)

*Primary Examiner* — Jessee Roe
(74) *Attorney, Agent, or Firm* — Oblon, McClelland, Maier & Neustadt, L.L.P.

(57) ABSTRACT

Disclosed is a pure titanium sheet having a strength corresponding to JIS Grade 2 level (215 MPa in terms of 0.2% yield strength) or more and having satisfactory stamping formability. The pure titanium sheet includes titanium and inevitable impurities, has a 0.2% yield strength of 215 MPa or more, has an average grain size d of its structure of 25 μm or more and 75 μm or less, and has a hexagonal crystal structure, in which respective grains in the hexagonal crystal structure have an average of Schmidt factors (SF) of (11-22) twins with a rolling direction as axes, and the average Schmidt factor (SF) and the average grain size d satisfy following Expression (1):

$$0.055 \leq [SF/\sqrt{d}] \leq 0.084 \quad (1).$$

18 Claims, 7 Drawing Sheets

(56) References Cited

OTHER PUBLICATIONS

English Abstract of Matsumoto et al. (JP 2002-317234) (Oct. 31, 2002).*
English Abstract of Shirai et al. (JP 2009-228092) (Oct. 8, 2009).*
ASM International, Materials Park, Ohio, Properties and Selection: Nonferrous Alloys and Special-Purpose Materials, "Wrought Titanium and Titanium Alloys", Oct. 1990, vol. 2, pp. 592-633.*
Extended Search Report issued May 16, 2012 in European Application No. 12000548.3.

* cited by examiner

SHAPE OF TESTING DIE

RATING 4

RATING 3

RATING 2

RATING 1

RATING 0

PURE TITANIUM SHEET EXCELLENT IN BALANCE BETWEEN STAMPING FORMABILITY AND STRENGTH

BACKGROUND OF INVENTION

The present invention relates to a titanium sheet (or plate) excellent in balance between stamping formability and strength. Specifically, the present invention relates to a pure titanium sheet which includes pure titanium corresponding to Grade 2 prescribed in Japanese Industrial Standards (JIS) H4600 (2007), has a 0.2% yield strength (hereinafter also referred to as "strength") of 215 MPa or more, and excels in stamping formability.

Titanium, as excelling in properties such as corrosion resistance, specific strength, and lightness in weight, has been adopted to a wide variety of fields and applications such as eyeglass frames; camera casings; cabinets typically of mobile devices; structures such as bicycles; exhaust system parts, such as mufflers, of motorcycles and automobiles; pipes and plates of heat exchangers; and electrodes of chemical plant tanks. Titanium is also expected to be adopted to advanced materials such as separators for fuel cells.

Pure titanium, which is heavily used in these applications, is prescribed in JIS H4600 standard and is categorized typically into JIS Grade 1, Grade 2, and Grade 3 by the contents of impurities such as iron (Fe) and oxygen (O), and the strength. With an increasing grade number, the pure titanium has an increasing minimum strength, and different grades of pure titanium are used in accordance with different purposes.

One of applications in which pure titanium sheets are mostly used is a plate heat exchanger (PHE). Titanium sheets to be adopted to this application are generally subjected to cold stamping into a complicated corrugated shape so as to have a larger heat exchange effective area in order to improve heat exchanger effectiveness. Specifically, they are exposed to a stamping environment which is extremely severe for the material. A pure titanium of JIS Grade 1 which is soft and is most liable to be formed among the grades is used as a pure titanium to be used under such severe stamping conditions.

However, such a titanium sheet requires further higher strength and more excellent formability, because improvements in heat exchanger effectiveness of a heat exchanger are performed not only based on the shape of the heat exchanger itself but also typically based on increase in flow rate of a heat medium (or cooling medium), and such a measure requires higher pressure tightness. Strength and stamping formability are, however, trade-off properties, and the fact is that no titanium sheet which satisfies the requirements in two properties has been proposed.

As techniques for improving stamping formability of pure titanium sheets, there have been proposed a technique of controlling the structure of titanium (Japanese Unexamined Patent Application Publication (JP-A) No. 2004-285457) and a technique of alloying titanium (Japanese Unexamined Patent Application Publication (JP-A) No. 2002-317234). These techniques, however, are intended to improve the formability of a pure titanium having a strength (yield strength) corresponding to JIS Grade 1, but are not intended to improve the formability of a pure titanium having a strength corresponding to JIS Grade 2. Specifically, twin deformation takes a major role in deformation in the pure titanium of JIS Grade 1; but a pure titanium having a strength corresponding to JIS Grade 2 is unlikely to undergo twin deformation and is not improved in formability when the techniques aiming at the pure titanium of JIS Grade 1 are adopted thereto without modification.

As a technique for improving the stamping formability of pure titanium having a strength corresponding to JIS Grade 2 or JIS Grade 3 (215 MPa or more), Japanese Unexamined Patent Application Publication (JP-A) No. 2009-228092 proposes a technique of controlling the contents of oxygen (O) and iron (Fe) and controlling titanium grain size. However, it is difficult to attain good balance between stamping formability and strength merely by controlling oxygen and iron contents and titanium grain size.

SUMMARY OF INVENTION

The present invention has been made in consideration of these circumstances and an object thereof is to provide a pure titanium sheet excellent in balance between stamping formability and strength.

Specifically, an object of the present invention is to provide a pure titanium sheet which has a strength corresponding to JIS Grade 2 level (215 MPa in terms of 0.2% yield strength) or more and has excellent stamping formability.

Solution to Problem

The present invention has achieved the objects and provides a pure titanium sheet including titanium and inevitable impurities. The pure titanium sheet has a 0.2% yield strength of 215 MPa or more. The pure titanium sheet has an average grain size d of its structure of 25 μm or more and 75 μm or less. The pure titanium sheet has a hexagonal crystal structure, respective grains in the hexagonal crystal structure have an average of Schmidt factors (SF) of (11-22) twins with a rolling direction as axes, and the average Schmidt factor (SF) and the average grain size d satisfy following Expression (1);

$$0.055 \leq [SF/\sqrt{d}] \leq 0.084 \quad (1)$$

The present invention provides a pure titanium sheet excellent in balance between stamping formability and strength by allowing, of the pure titanium sheet, the Schmidt factor of specific plane of grains and the average grain size to satisfy the predetermined condition. The resulting pure titanium sheet is extremely useful as a material having such satisfactory stamping formability and high strength as required when the pure titanium sheet is used as a shaped article having a complicated shape typically in a heat exchanger or chemical plant. In particular, the pure titanium sheet is useful as a material for a plate heat exchanger.

DESCRIPTION OF EMBODIMENTS

Figure 1A:
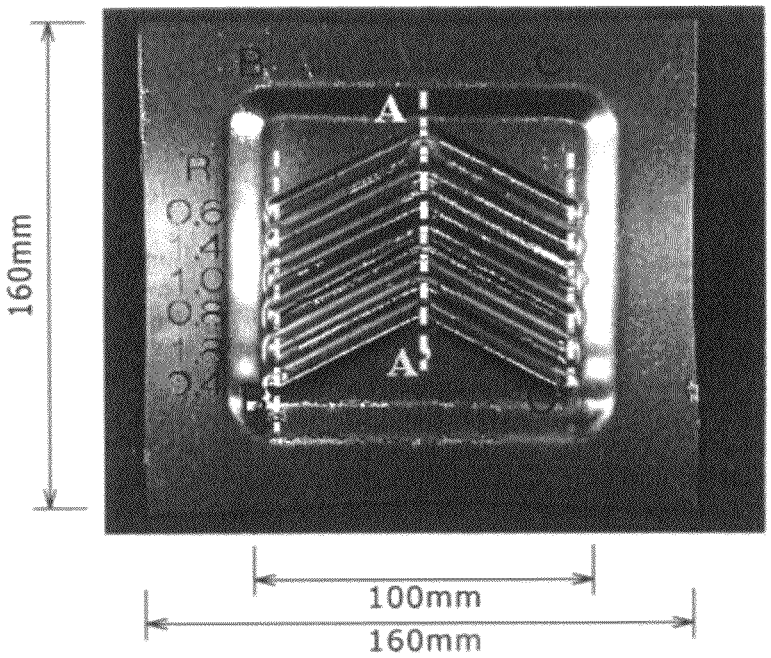
FIG. 1A is a plan view illustrating how to evaluate stamping formability.

Regarding formability, a pure titanium sheet is known to have more satisfactory stamping formability with an increasing susceptibility of twin formation, because, in addition to slip deformation, twin deformation also largely contributes to deformation of the pure titanium sheet. The softer pure titanium is, the more deformation twinning occurs and the better the stamping formability is. For these reasons, pure titanium sheets having a strength corresponding to JIS Grade 2 or Grade 3 (strength of from 215 MPa and less than 485 MPa) are known to undergo less deformation twinning and to have inferior stamping formability as compared to pure titanium sheets having a strength corresponding to JIS Grade 1 (strength of 165 MPa or more).

The present inventors made various investigations on the metal structure so as to improve stamping formability (particularly stamping formability as a shaped article having a complicated shape, such as a plate heat exchanger) while maintaining a high strength level (strength of 215 MPa or more) corresponding to JIS Grade 2 or Grade 3; and they obtained the following findings.

A titanium sheet, when cold-rolled in one direction, undergoes strength anisotropy and thereby has a strength in the rolling direction lower than that in a cross direction with low ductility. When this titanium sheet is subjected to stamping (pressing), deformation in the rolling direction with a low strength proceeds preferentially. Based on these, the present inventors considered that structure control to enhance twin deformation in a main deformation direction, i.e., in the rolling direction is effective for improving stamping formability and found that it is also important for titanium sheets of JIS Grade 2 or Grade 3 to align crystal orientations which facilitate deformation twinning.

The present inventors made investigations on Schmidt factor and grain size both of which affect the occurrence tendency of deformation twinning and have found that control of the relation between the Schmidt factor and the grain size within a specific range allows a pure titanium sheet to have higher stamping formability while maintaining a high strength level. The present invention has been made based on these findings.

Specifically, a titanium sheet having especially excellent stamping formability while maintaining a high strength level corresponding to JIS Grade 2 or Grade 3 can be obtained when, in a pure titanium sheet which has been rolled in one direction and which has a hexagonal crystal structure, the average of Schmidt factors (SF) and the average grain size (d in μm) of titanium sheet structure satisfy a condition represented by Expression (1), i.e., $[0.055 \leq [SF/\sqrt{d}] \leq 0.084$ (where $25 \leq d \leq 75$)] (hereinafter also simply referred to as Expression (1)). The Schmidt factors are of twin deformations with the rolling direction as axes in the (11-22) plane of the hexagonal crystal structure.

Miller indices indicate crystal planes (crystal faces). When an index is minus, it is generally indicated as a number with a bar thereover. However, in this specification, such a minus index is indicated by a "minus number" for the sake of convenience. Accordingly, the indication "−2" in the (11-22) plane indicates that the index is minus.

The present invention employs the Schmidt factor as an index for the improvement of stamping formability. It is known that the magnitude of critical shearing stress (τ) required for moving dislocation along with a crystal plane generally varies depending on the crystal plane and crystal axis direction and is given by the expression: $\tau = \sigma \cos \phi * \cos \lambda$ where σ represents a tensile stress in the axis direction: φ represents an angle formed by the slip plane normal line and the tension axis; and λ represents an angle formed by the slip direction and the tension axis.

The [cos φ*cos λ] in Expression (1) is called Schmidt factor and indicates the slope of crystal in the tension axis. Accordingly the critical shearing stress (τ) necessary for plastic deformation of a metal polycrystal varies depending on the Schmidt factor ([ cos φ·cos λ]) and, when an external force is applied to a metal sheet, a crystal plane having a maximum Schmidt factor deforms at first.

In a pure titanium sheet, the critical shearing stress (τ) necessary for the crystalline deformation may be determined by calculating the average of Schmidt factors (average Schmidt factor; SF) based on the relationship between the angle φ and the angle λ.

A crystal grain (main phase α) of a pure titanium has a hexagonal close-packed lattice structure as its crystal structure. When the pure titanium has a strength corresponding to JIS Grade 1, it is known that twin deformation is most likely to occur in the (11-22) plane of the crystal grain. The present inventors have verified that a pure titanium sheet having a strength corresponding to JIS Grade 2 or Grade 3 has better stamping formability with an increasing Schmidt factor in the (11-22) plane of a crystal grain in the rolling direction (tension axis direction). Based on the findings, the present invention employs, as an average Schmidt factor (SF), the value in the (11-22) plane of respective crystal grains with the rolling direction as axes in the hexagonal crystal structure of the titanium sheet.

In the present invention, the range of the average Schmidt factor (SF) is not critical, as long as the ratio ($SF/\sqrt{d}$) of the average Schmidt factor (SF) to the square root of the average grain size (d) is within the specific range ($0.055 \leq [SF/\sqrt{d}] \leq 0.084$) as in Expression (1). The pure titanium sheet, when having an average Schmidt factor (SF) satisfying the above condition, may have satisfactory stamping formability regardless of lubrication conditions.

In the present invention, the pure titanium sheet should have an average titanium grain size (d in μm) of 25 μm or more. The pure titanium sheet, if having an average grain size of less than 25 μm, may hardly undergo deformation twinning and may have inferior stamping formability due to insufficient stress at grain boundaries, which stress is necessary for twin deformation. For this reason, the lower limit of the average titanium grain size is set to be 25 μm. The pure titanium sheet has an average grain size of preferably 30 μm or more, and more preferably 35 μm or more.

The titanium sheet, if having an excessively large average grain size of titanium grains, may suffer from inferior design function (appearance) due to orange peel surface generated on the surface thereof and may suffer from cracking from grain boundaries upon forming (shaping) because of coarsened crystal grains and focusing stress at grain boundaries. For these reasons, the pure titanium sheet desirably has an average grain size of 75 μm or less, preferably 65 μm or less, and more preferably 55 μm or less.

The relationship between the average Schmidt factor (SF) and the average grain size (d in μm) is expressed by $[SF/\sqrt{d}]$, i.e., the average Schmidt factor (SF) divided by the square root of the average grain size (d). The average Schmidt factor (SF) is divided by the square root of the average grain size (d), because the degree of occurrence of twin deformation, which affects stamping formability, can be expressed by the crystal orientation, i.e., "SF" and the magnitude of internal stress which induces twin deformation. The magnitude of internal stress is proportional to the inverse of the square root of the average grain size (d in μm). The pure titanium sheet, if having a [SF/√d] of less than 0.055, may fail to have satisfactory stamping formability because it has a large grain size, and deformation twinning occurs in random directions. For these reasons, the value [SF/√d] herein is, as its lower limit, 0.055 or more and is preferably 0.058 or more, and more preferably 0.061 or more. In contrast, the pure titanium sheet, if having a [SF/√d] of more than 0.084, may have insufficient stamping formability, because grains have excessively small sizes to cause insufficient internal stress at grain boundaries and to thereby impede deformation twinning. For these reasons, the value [SF/√d] herein is, as its upper limit, 0.084 or less, and is preferably 0.081 or less, and more preferably 0.078 or less.

A pure titanium sheet to which the present invention is adopted is designed to have a composition approximately corresponding to that of industrially used pure titanium (Grade 2 or Grade 3 prescribed in JIS H4600). Accordingly, the pure titanium sheet preferably has such a chemical composition as to satisfy a chemical composition prescribed as JIS Grade 2 or JIS Grade 3 and has a strength (0.2% yield strength) of 215 MPa or more. The present invention may also be adopted to pure titanium sheets prescribed in other standards, such as American Society for Testing and Materials' Standards (ASTM Standards), corresponding to JIS Grade 2 or JIS Grade 3. Specifically, typical examples of pure titanium sheets to which the present invention is adopted include JIS H4600 (2007) Grade 2 (N: 0.03 percent by mass or less, C: 0.08 percent by mass or less, H: 0.013 percent by mass or less, Fe: 0.25 percent by mass or less, and O: 0.20 percent by mass or less, with the remainder including Ti), JIS Grade 3 (N: 0.05 percent by mass or less, C: 0.08 percent by mass or less, H: 0.013 percent by mass or less, Fe: 0.30 percent by mass or less, and O: 0.30 percent by mass or less, with the remainder including Ti), ASTM B265 Grade 1 (N: 0.03 percent by mass or less, C: 0.08 percent by mass or less, H: 0.015 percent by mass or less, Fe: 0.20 percent by mass or less, and O: 0.18 percent by mass or less, with the remainder including Ti), and Grade 2 (N: 0.03 percent by mass or less, C: 0.08 percent by mass or less, H: 0.015 percent by mass or less, Fe: 0.30 percent by mass or less, and O: 0.25 percent by mass or less, with the remainder including Ti). It should be noted, however, these are illustrated only by way of example and are not construed to limit the scope of the present invention.

A method for manufacturing a pure titanium sheet according to the present invention will be illustrated below. It should be noted, however, that pure titanium sheets according to the present invention are not limited to those manufactured by the following method.

The present invention may employ a regular method for manufacturing a pure titanium, in which manufacturing conditions are not limited, except for desirable cold rolling conditions and annealing conditions as mentioned below.

A pure titanium sheet is generally manufactured through sequential processes of casting, blooming, hot rolling, post-hot-rolling annealing, cold rolling, process annealing (intermediate annealing), cold rolling, and final annealing.

Typically, a pure titanium controlled to have a specific chemical composition is subjected typically to ingot-making/forging to have a desired shape (such as a block shape) and is hot-rolled to give a hot-rolled sheet. The resulting hot-rolled sheet is subjected sequentially to annealing, acid-wash for descaling, cold rolling, and annealing and thereby yields a pure titanium sheet according to the present invention.

Among these processes for manufacturing the pure titanium sheet according to the present invention, the cold rolling process immediately before final annealing and the final annealing process are important processes (steps), and their conditions are important for controlling the average Schmidt factor (SF) of the (11-22) plane and the average grain size (d) and controlling the value [SF/√d] within the above-specified ranges.

For the control of SF, the present inventors made investigations on the relationship between SF and the cold reduction and have found that, cold rolling, when performed to a cold reduction of 68% or more, gives such a crystal orientation as to be susceptible to twin deformation, i.e., as to have a high SF, and this provides satisfactory stamping formability. With an increasing rolling reduction (draft) in the cold rolling, the SF increases and the stamping formability is more improved. Accordingly, the cold rolling is performed to a rolling reduction of preferably 70% or more, and more preferably 80% or more. The rolling reduction is not limited in its upper limit, and may be increased to a reduction limit in cold rolling.

While details remain unknown, this is probably because as follows. If the cold rolling is performed to a cold reduction of less than 68%, crystal grains having high Schmidt factors before cold rolling deform preferentially in the cold rolling, and recrystallized grains in the area thereby become relatively fine. In contrast, crystal grains having low Schmidt factors are resistant to deformation, thereby do not undergo recrystallization upon annealing, and are liable to remain as relatively large crystal grains. The former grains which undergo deformation are liable to form crystal grains having high Schmidt factors upon recrystallization. Generally in polycrystalline grain growth, a large grain invades a small grain to form a coarse grain; and for these reasons, a grain having a lower Schmidt factor (but having a larger grain size) may invade a grain having a higher Schmidt factor (but having a smaller grain size) upon annealing, resulting in a low average Schmidt factor (SF). In contrast, when intense cold rolling is performed to a reduction of 68% or more, even a crystal grain having a low Schmidt factor deforms in a larger amount and thereby forms a fine recrystallized grain during annealing, and a crystal grain having a high Schmidt factor is newly generated, resulting in a high average Schmidt factor (SF). On the other hand, a crystal grain having a high Schmidt factor increasingly deforms from the early stages of rolling, bears a strain accumulated in a large amount, and thereby preferentially grows in the grain growth after recrystallization, namely, the crystal grain having a high Schmidt factor invades a crystal grain having a low Schmidt factor, and these allow the pure titanium sheet to have a high average Schmidt factor (SF) to thereby have improved stamping formability. The present inventors consider as above.

As used herein the term "cold reduction" (rolling reduction of cold rolling) refers to a rolling reduction only of the cold rolling immediately before the finish annealing (final annealing). Though cold rolling in multiple times may be performed according to necessity in the present invention, the rolling reduction of the final cold rolling most affects the average Schmidt factor (SF), and only the rolling reduction in the final cold rolling is specified herein.

According to the present invention, after performing the cold rolling to a rolling reduction of 68% or more, finish annealing (final annealing) is performed. The grain size and titanium crystal orientation may be suitably controlled by regulating conditions, such as temperature and holding time, of the final annealing.

The rate of temperature rise upon annealing may be suitably regulated, but is preferably 20° C./s or more, and more preferably 25° C./s or more, because annealing performed at an excessively low rate of temperature rise may fail to give a crystal orientation suitable for stamping.

Annealing temperature is desirably suitably controlled because it affects, for example, the grain size. The annealing, if performed at an excessively high temperature, may cause a large amount of beta phase and may thereby the titanium sheet to have insufficient stamping formability. To avoid this, the annealing temperature is desirably preferably 880° C. or less, and more preferably 860° C. or less. In contrast, the annealing, if performed at an excessively low temperature, may fail to give the desired grain size. The annealing temperature is therefore preferably 750° C. or more, and more preferably 800° C. or more. However, even if annealing is performed at a temperature lower than the above range, crystal grains can be controlled within the above-specified range by performing the annealing for a long holding time. The annealing, however, is desirably performed at a temperature within the above-specified temperature range from the viewpoint of productivity.

Holding time at the annealing temperature is preferably 1 minute or longer and 10 minutes or shorter. The annealing, if performed for an excessively short holding time, may fail to give crystal grains having the desired size. In contrast, the annealing, if performed for an excessively long holding time, may cause inferior production efficiency and an excessively large grain size, thus being undesirable. The holding time is more preferably 2 minutes or longer and 6 minutes or shorter.

The final annealing treatment may be performed in an air atmosphere but may also be performed in any atmosphere not limited, such as a vacuum atmosphere or an atmosphere of an inert gas such as Ar gas.

To obtain an average grain size within the desired range, annealing may be repeated multiple times for the control of grain sizes.

By adopting a suitable combination of the rolling reduction of the cold rolling immediately before final annealing, and the conditions of the subsequent final annealing as mentioned above, a pure titanium sheet according to the present invention having a high strength and excellent formability can be manufactured.

Techniques of coating a titanium sheet with a lubricating oil or of forming a lubricating film on a surface of the titanium sheet are known. These techniques are performed to ensure satisfactory stamping formability upon stamping. According to these techniques, the titanium sheet is allowed to deform along a die to thereby have improved stamping formability by the action of a press oil, or by the action of a lubricating film formed on the surface of the titanium sheet. The pure titanium sheet according to the present invention basically exhibits satisfactory stamping formability without the application of a lubrication film as above. However, a film with high lubricity may be formed on the surface of the titanium sheet according to necessity. The pure titanium sheet, when undergoing such a lubricating process, can have furthermore satisfactory stamping formability.

Exemplary lubricating processes include a process of coating the titanium sheet with a lubricating oil such as a press oil; a process of covering the surface of the titanium sheet with a film such as a poly(ethylene film); and a process of covering the surface of the titanium sheet with an organic resin mainly containing, for example, a polyurethane resin or a polyolefin resin. Such a lubricating film may be one added with a silica-based inorganic solid lubricant.

The titanium sheet according to the present invention is adopted as a material typically for heat exchangers and chemical plants and is particularly advantageous as a material for plate heat exchangers. The titanium sheet according to the present invention exhibits satisfactory stamping formability when adopted as the material. The titanium sheet may have any gage not critical, but, if the titanium sheet has an excessively large gage, the working on the titanium sheet itself may be difficult. For these reasons, the titanium sheet according to the present invention is preferably adopted to a titanium sheet having a gage usable in a desired use and can be adopted, for example, to a titanium sheet having a gage of 2 mm, though the upper limit of a concrete gage is not specified herein. The lower limit of the gage may also be determined in consideration typically of necessary strength. The titanium sheet according to the present invention, as having high strength, can be sufficiently adopted even to one having a gage of 0.1 mm.

A pure titanium sheet for use in the present invention includes titanium and inevitable impurities. As used herein the term "inevitable impurities" refers to impurity elements inevitably contained in raw material titanium sponges. Typical examples thereof include oxygen, iron, carbon, nitrogen, hydrogen, chromium, and nickel. Examples of inevitable impurities further include elements which may be incorporated into a product during manufacturing processes, such as hydrogen.

Though not critical, the contents of inevitable impurities contained in the titanium sheet are preferably suitably reduced, because large contents of impurities may impede performing of manufacture under preferred conditions in the present invention, namely, it may impede the performing of cold rolling before final annealing to a cold reduction of 68% or more upon the manufacture typically of a coil.

Typically, oxygen element is effective to allow the titanium sheet to have satisfactory strength. To allow oxygen to exhibit such effects, the oxygen content may be 0.06% or more (percentage is on the mass basis (percent by mass), the same is true for the chemical composition), and more preferably 0.08% or more. However, the titanium sheet, if having an excessively high oxygen content, may have excessively high strength and may have insufficient cold workability and/or stamping formability. For these reasons, the oxygen content is desirably 0.3% or less, preferably 0.2% or less, and more preferably 0.15% or less.

Iron element is also effective to allow the titanium sheet to have satisfactory strength as with oxygen and may be contained in the titanium sheet according to necessity to supplement the strengthening effect of oxygen. However, iron, if contained in an excessively large content, may cause the titanium sheet to have excessively high strength to thereby have insufficient cold workability and/or stamping formability and to exhibit inferior resistance to crevice corrosion. To avoid these, the iron content is desirably 0.50% or less, and preferably 0.35% or less.

Carbon element is also effective to ensure the strength of the titanium sheet as with oxygen and iron. However, the titanium sheet, if containing carbon in an excessively high content, may have excessively high strength and may thereby have insufficient cold workability and/or stamping formability. To avoid these, the carbon content is preferably 0.05% or less, and more preferably 0.03% or less.

EXAMPLES

The present invention will be illustrated in further detail with reference to several working examples below. It should be noted, however, that these examples are never intended to limit the scope of the present invention; various changes and modifications may be made without departing from the scope and spirit of the invention, and it is intended to cover all such changes and modifications as fall within the true spirit and scope of the invention.

Test materials each having a gage of 3.5 mm were prepared by subjecting pure titanium sheets (gage: 200 mm) having chemical compositions 1 to 3 (JIS H4600) given in Table 1 below to hot rolling (rolling conditions: rolling at 830° C. from gage 200 mm to gauge 4.0 mm), annealing, and acid wash treatment (acid wash conditions: one side 250 μm).

The prepared test materials were subjected sequentially to post-hot-rolling annealing (see Table 2), a first cold rolling treatment, and process annealing (see Table 2). The specimens were subsequently subjected to a second cold rolling treatment (to a rolling reduction given in "Cold Reduction Before Final Annealing" in Table 2) and thereby yielded cold-rolled materials having a gage of 0.6 mm. The cold-rolled materials were subjected, in an air atmosphere, to final annealing (average rate of temperature rise of about 20° C./s, at an annealing temperature for a holding time at the annealing temperature both given in Table 2) and to acid wash (salt treatment: 50 μm per one side), and thereby yielded specimens (0.5 mm in gage).

Independently, a referential example (Specimen A) having a chemical composition ("Chemical Composition 2" in Table 1) and a strength each corresponding to JIS Grade 2 was prepared.

On the respective specimens, the average grain size (d), average Schmidt factor (SF), stamping formability (Score), and strength were measured by the following methods, and the results are shown in Table 3.

(1) Average Grain Size (d in μm)

The average grain size (d) of each specimen was determined according to a section method using an optical microphotograph of each specimen at a magnification of 100 times. The determination was performed on a cross section in the rolling direction of the specimen at an arbitrary position over the entire thickness (0.5 mm) in a region of 0.7 mm in the rolling direction.

(2) Average Schmidt Factor (SF)

The average Schmidt factor (SF) in the (11-22) plane of hexagonal crystal with the rolling direction as a tension axis was determined in the following manner. Schmidt factors of respective crystal grains were measured in an arbitrary area 1.8 mm long, 1.8 mm wide, and one fourth the gage (t×¼, where t represents the gage) deep according to a crystal orientation analysis using an electron backscatter diffraction pattern at a pitch of one tenth the crystal grain, and the average of Schmidt factors of respective crystal grains was determined as the average Schmidt factor (SF).

(3) Stamping Formability (Score)

Figure 1B:
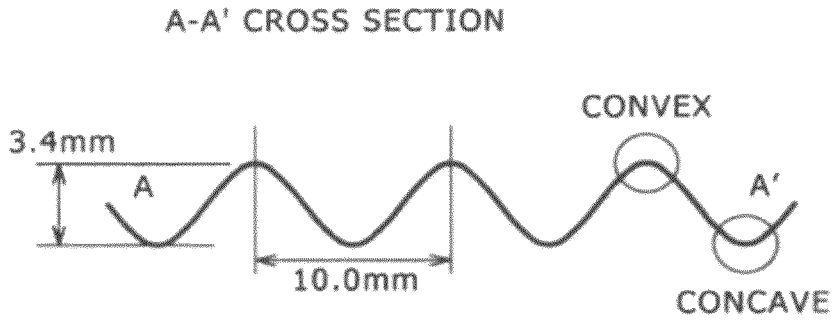
FIG. 1B is a schematic cross-sectional view taken along Line A-A' of FIG. 1A.

FIGS. 1A and 1B are explanatory drawings illustrating how to evaluate stamping formability. Using the above-prepared specimens, stamped specimens each simulating a heat exchange unit of a plate heat exchanger were prepared through stamping (pressing) using a 80-ton oil hydraulic pressing machine. The stamped specimens each had a size of 160 mm wide and 160 mm long (evaluated area: 100 mm wide and 100 mm long), in a herringbone pattern having six ridges at a pitch of 10 mm, a maximum height of 4 mm, and six radii of curvature R of 0.4, 0.6, 0.8, 1.0, 1.4, and 1.8 (mm), in which the six ridges had six different radii of curvature R respectively. The stamping was performed under conditions of a rate of 1 mm/second, a press depth (length of penetration) of 3.4 mm, a maximum load of 200 kN, and a mass of coating of lubricant of 1.0 g/m$^2$. For lubrication, any of following Lubricants 1 to 3 was used.

Lubricant 1 (film): Polyethylene film

Lubricant 2: Press oil (SUNPRESS S-304 supplied by Sugimura Chemical Industrial Co., Ltd.)

Lubricant 3 (film): Lubricating film (containing 80 percent by mass of an acrylic resin, 10 percent by mass of colloidal silica, and 10 percent by mass of a polyethylene wax)

Cracking of the stamped specimens was measured at twenty-four points of intersection of the ridges and broken lines (twelve points at ridge ends (convex) and twelve points at ridge centers (six convexes and six concaves) as illustrated in FIGS. 1A and 1B, where FIG. 1A is a plan view; and FIG. 1B is a cross-sectional view.

Evaluation points regarding Line A-A', Line B-B', and Line C-C' each serving as a cracking origin were rated, by visual observation, as rating 4 when the specimen showed no defect; as rating 3 when the specimen had necking (necking phenomenon) tendency; as rating 2 when the specimen had necking; as rating 1 when the specimen suffered from a fine crack; and as rating 0 when the specimen suffered from a large crack (see following Expression (2)). The cracking state was converted into numbers by multiplying the ratings by the inverses of radii of curvature R (these are all together indicated as R(ij)) respectively, and the ratio of this value to a value in the case assuming that all the measured points showed no cracking was defined as a "score" (following Expression (3)). The score is used in the present invention as an index for the evaluation of the stamping formability.

$$E(ij)=(\text{without defect:4,necking tendency:3,necking:2, fine crack:1,large crack:0}) \quad (2)$$

$$\text{Score}=[\Sigma E(ij)/R(ij)]/[\Sigma 4/R(ij)]\times 100 \quad (3)$$

Figure 6:
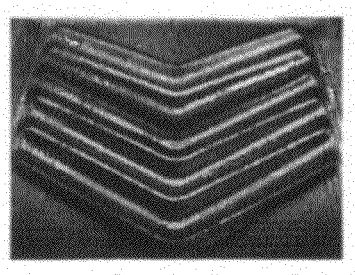
FIG. 6 depicts photographs illustrating evaluation criteria on the results of stamping tests.
Figure 6:
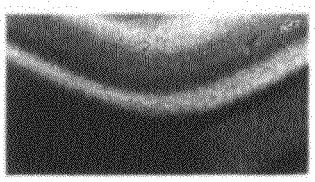
Figure 6:
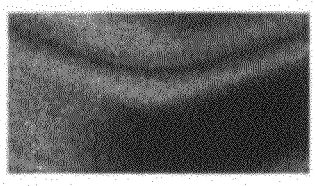
Figure 6:
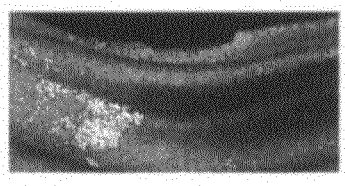
Figure 6:
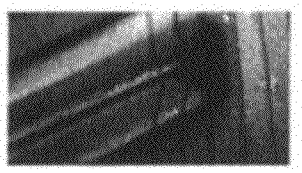
Figure 6:
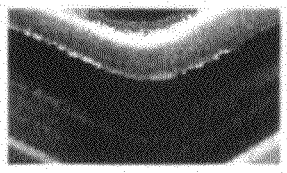

As illustrated in FIG. 6, the "necking tendency" refers to such a state that necking generation is recognized not by visual observation but by touch inspection; "necking" refers to such a state that slimming of part of the specimen is detected by visual observation; "fine crack" refers to a crack generated in a deformed portion; and "large crack" refers to a crack of 3 mm or more.

(4) Strength (MPa)

The strength was determined by sampling a specimen prescribed in ASTM and measuring a yield stress (0.2% yield strength) of the specimen in a longitudinal (L) direction (rolling direction) in accordance with test methods for tension testing of metallic materials prescribed in ASTM E8. The tension testing was performed at a rate of 0.5%/min from the beginning of the test to a strain of 0.5%, and at a rate of 40%/min thereafter.

TABLE 1

| | Chemical Composition (percent by mass) | | |
|---|---|---|---|
| Number | O | Fe | C |
| Chemical Composition 1 | 0.094% | 0.054% | 0.006% |
| Chemical Composition 2 | 0.081% | 0.055% | 0.008% |
| Chemical Composition 3 | 0.101% | 0.057% | 0.006% |

Inevitable impurities other than O, Fe, and C are within the ranges prescribed in JIS Grade 2.

The remainder is titanium.

TABLE 2

| Specimen | Chemical composition No. | Post-hot-rolling annealing conditions Temperature (° C.) | Post-hot-rolling annealing conditions Time (min) | First cold reduction (%) | Process annealing conditions Temperature (° C.) | Process annealing conditions Time (min) | Cold reduction before final annealing (%) | Final annealing conditions Temperature (° C.) | Final annealing conditions Time (min) |
|---|---|---|---|---|---|---|---|---|---|
| 1 | 2 | 800 | 3 | — | — | — | 82.9 | 800 | 1 |
| 2 | 3 | 800 | 3 | — | — | — | 82.9 | 800 | 2 |
| 3 | 1 | 800 | 3 | — | — | — | 82.9 | 800 | 3 |
| 4 | 1 | 800 | 3 | — | — | — | 82.9 | 800 | 6 |
| 5 | 2 | 800 | 3 | — | — | — | 82.9 | 750 | 2 |
| 6 | 3 | 800 | 3 | 43 | 800 | 3 | 70 | 800 | 2 |
| A | 2 | 750 | 3 | 57 | 800 | 3 | 60 | 750 | 0.8 |
| B | 1 | 800 | 3 | — | — | — | 82.9 | 740 | 15 |
| C | 2 | 800 | 3 | 57 | 800 | 3 | 60 | 800 | 6 |
| D | 1 | 800 | 3 | — | — | — | 82.9 | 700 | 3 |
| E | 2 | 800 | 3 | 57 | 800 | 3 | 60 | 750 | 6 |
| F | 3 | 800 | 3 | 68 | 800 | 3 | 50 | 800 | 2 |
| G | 3 | 800 | 3 | 74 | 800 | 3 | 30 | 800 | 2 |
| H | 3 | 800 | 3 | 80 | 800 | 3 | 10 | 800 | 2 |

TABLE 3

| Category | Specimen | Average grain size d (μm) | Average Schmidt factor SF | SF/√d | Score (%) Lubricant 1 | Score (%) Lubricant 2 | Score (%) Lubricant 3 | 0.2% Yield strength (MPa) |
|---|---|---|---|---|---|---|---|---|
| Example | 1 | 30.8 | 0.43 | 0.077 | 83.0 | 63.0 | 72.8 | 233 |
| Example | 2 | 36.9 | 0.44 | 0.072 | 86.3 | 64.2 | 75.8 | 229 |
| Example | 3 | 48.9 | 0.44 | 0.062 | 83.5 | 63.2 | 74.2 | 223 |
| Example | 4 | 64.5 | 0.45 | 0.056 | 77.1 | 58.1 | 66.9 | 220 |
| Example | 5 | 25 | 0.41 | 0.083 | 79.8 | 59.3 | 69.2 | 235 |
| Example | 6 | 45.4 | 0.41 | 0.061 | 80.0 | 59.2 | 68.1 | 229 |
| Comparative Example | A | 22.0 | 0.40 | 0.085 | 74.0 | 55.2 | 65.1 | 230 |
| Comparative Example | B | 72.3 | 0.45 | 0.053 | 74.5 | 54.6 | 64.1 | 220 |
| Comparative Example | C | 67.5 | 0.41 | 0.049 | 72.4 | 53.4 | 62.2 | 219 |
| Comparative Example | D | 18 | 0.36 | 0.086 | 71.3 | 51.0 | 59.9 | 243 |
| Comparative Example | E | 60.2 | 0.38 | 0.049 | 68.2 | 47.9 | 57.3 | 232 |
| Comparative Example | F | 47 | 0.36 | 0.053 | 73.2 | 53.2 | 58.7 | 238 |
| Comparative Example | G | 46 | 0.36 | 0.053 | 72.0 | 52.6 | 56.4 | 251 |
| Comparative Example | H | 50.7 | 0.35 | 0.049 | 71.0 | 51.2 | 56.2 | 250 |

Table 3 indicates that Specimens 1 to 6 satisfying the conditions (SF/√d and d) specified in the present invention had strengths (0.2% yield strengths) of 215 MPa or more corresponding to JIS Grade 2 and had satisfactory stamping formability.

In contrast, Specimens A to H having values SF/√d out of the range specified in the present invention had inferior stamping formability, although they had strengths of 215 MPa or more.

Specifically, data on Specimens C, E, F, G, and H demonstrate that titanium sheets, if undergone cold rolling before final annealing performed to a low cold reduction (rolling reduction), tend to have a not-so-high average Schmidt factor (SF) but to have a large average grain size, and are thereby liable to have inferior stamping formability because of the value SF/√d being out of the range specified in the present invention.

Data on Specimen A demonstrate that a titanium sheet, if undergone final annealing for a short time, fails to have sufficient grain growth and, if undergone cold rolling before final annealing to a low cold reduction, fails to have a sufficiently high average Schmidt factor, and is liable to have inferior stamping formability because of the value SF/√d being out of the range specified in the present invention.

Data on Specimen No. B demonstrate that a titanium sheet, if undergone final annealing for an excessively long time even at a low temperature, suffers from excessive grain growth, thereby has inferior balance between SF and the average grain size, and is liable to have inferior stamping formability because of the value SF/√d being out of the range specified in the present invention.

Specimen D is a specimen which underwent final annealing at an excessively low temperature and suffered from insufficient grain growth and an insufficient grain size.

Figure 2:
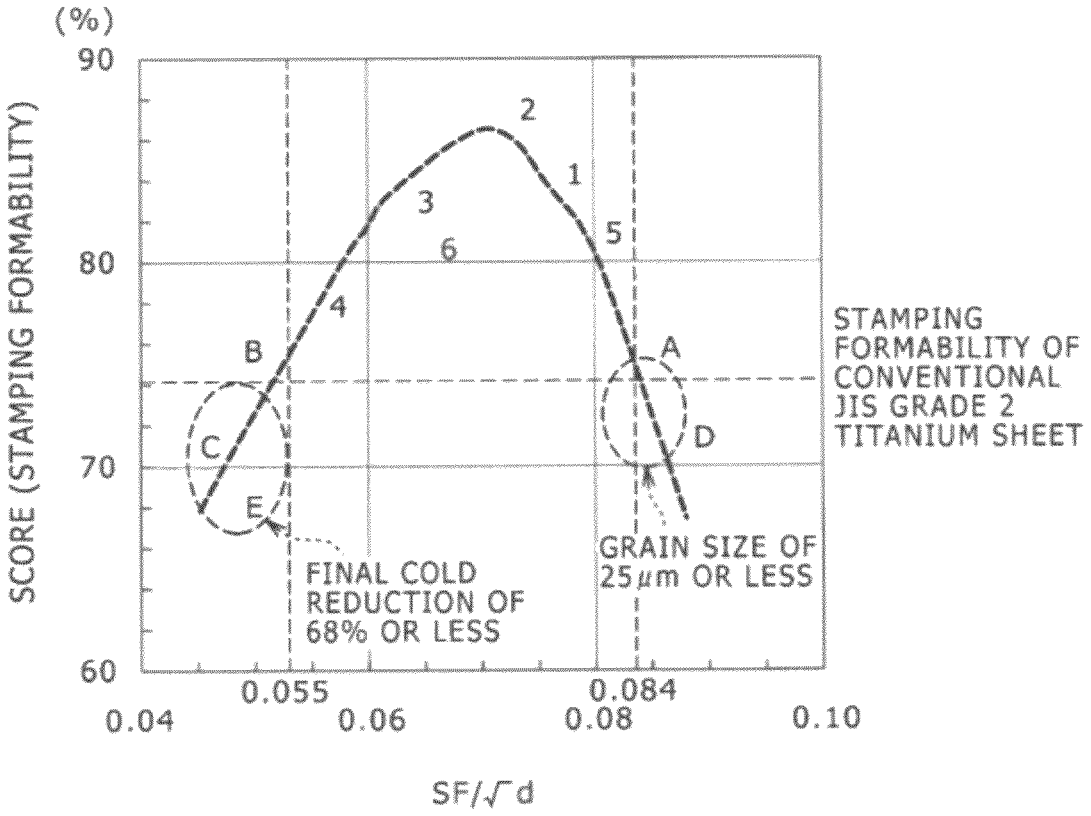
FIG. 2 is a graph illustrating how the stamping formability varies depending on a value (SF/√d) upon the use of Lubricant 1 in working examples.
Figure 3:
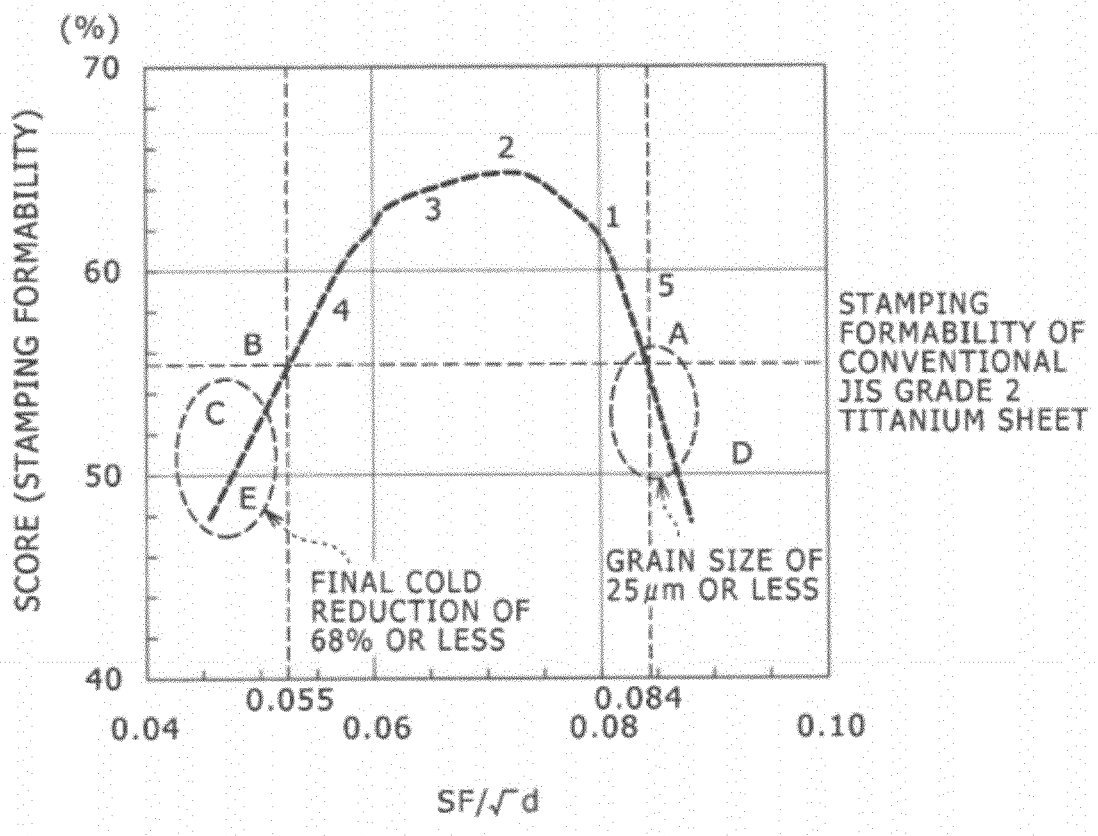
FIG. 3 is a graph illustrating how the stamping formability varies depending on the value (SF/√d) upon the use of Lubricant 2 in working examples.
Figure 4:
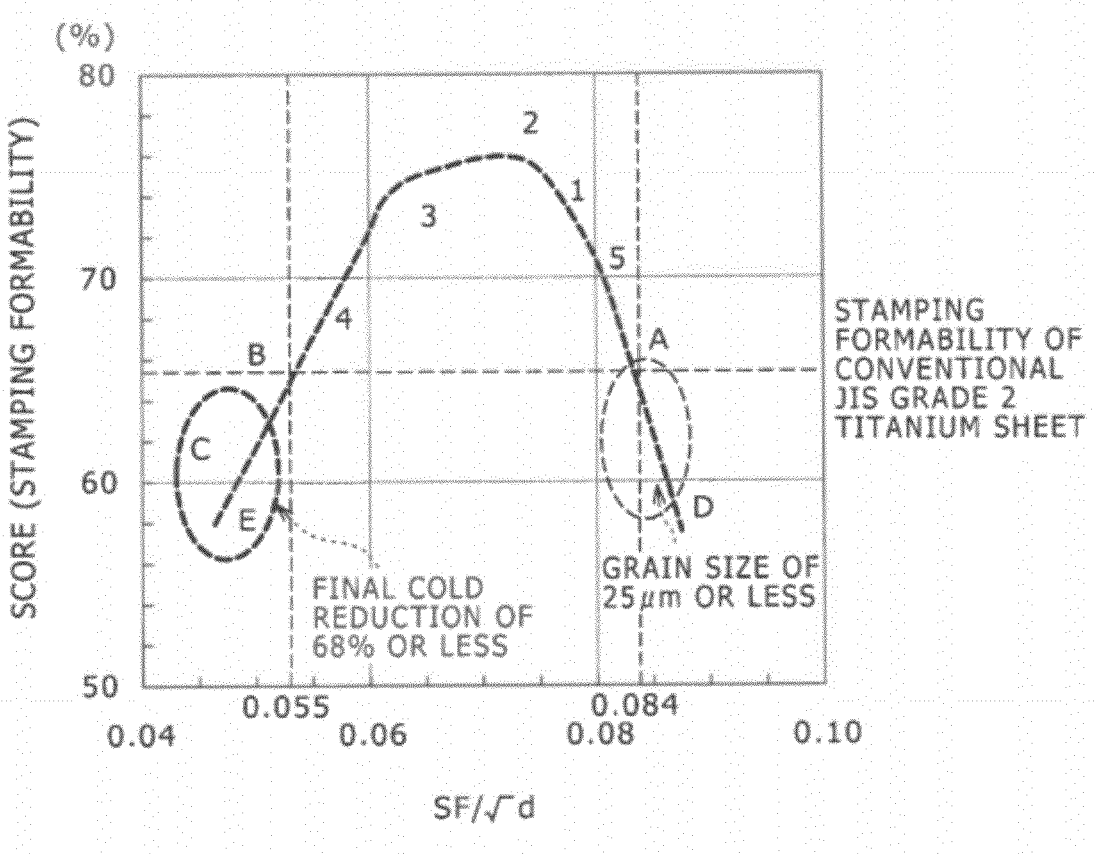
FIG. 4 is a graph illustrating how the stamping formability varies depending on the value (SF/√d) upon the use of Lubricant 3 in working examples.

FIGS. 2 to 4 are graphs illustrating how the stamping formability varies depending on lubrication conditions. Data as illustrated in FIGS. 2 to 4 demonstrate that the pure titanium sheets according to the present invention satisfying the condition on SF/√d exhibit higher stamping formability than that of the referential titanium sheet of JIS Grade 2 (Specimen A) under any lubrication conditions (Lubricants 1 to 3). FIGS. 2, 3, and 4 are graphs upon the use of Lubricant 1, Lubricant 2, and Lubricant 3, respectively.

Figure 5:
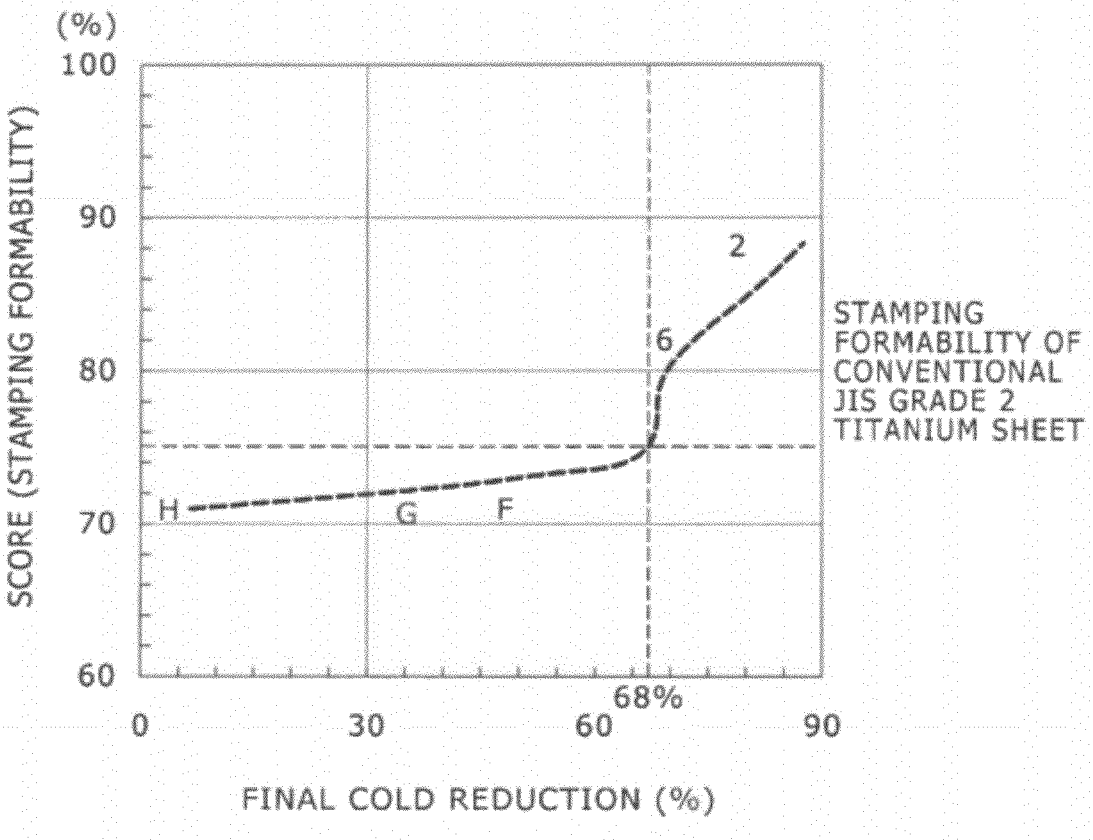
FIG. 5 is a graph illustrating how the stamping formability varies depending on the rolling reduction in cold reduction before final annealing (final cold reduction)

FIG. 5 is a graph illustrating how the stamping formability varies depending on the rolling reduction (final cold reduction) of cold rolling before final annealing upon the use of Lubricant 1. FIG. 5 demonstrates that titanium sheets, when undergone the final cold rolling to a high rolling reduction, exhibit stamping formability higher than that of the referential titanium sheet of JIS Grade 2 (Specimen A).

What is claimed is:

1. A pure titanium sheet comprising titanium and inevitable impurities, the pure titanium sheet having a 0.2% yield strength of 215 MPa or more, the pure titanium sheet having an average grain size d of its structure of 25 μm or more and 75 μm or less, and the pure titanium sheet having a hexagonal crystal structure, respective grains in the hexagonal crystal structure having an average of Schmidt factors (SF) of (11-22) twins with a rolling direction as axes, and the average Schmidt factor (SF) and the average grain size d satisfying following Expression (1):

$$0.055 \leq [SF/\sqrt{d}] \leq 0.084 \quad (1).$$

2. A plate heat exchanger comprising the titanium sheet of claim 1 as a constituent.

3. The pure titanium sheet of claim 1, which has an average grain size d of its structure of 30 μm to 65 μm.

4. A plate heat exchanger comprising the pure titanium sheet of claim 3 as a constituent.

5. The pure titanium sheet of claim 1, which has an average grain size d of 35 μm to 55 μm.

6. A plate heat exchanger comprising the pure titanium sheet of claim 5 as a constituent.

7. The pure titanium sheet of claim 1, the average Schmidt factor (SF) and the average grain size d satisfying following Expression (1):

$$0.058 \leq [SF/\sqrt{d}] \leq 0.081 \quad (1).$$

8. A plate heat exchanger comprising the pure titanium sheet of claim 7 as a constituent.

9. The pure titanium sheet of claim 1, the average Schmidt factor (SF) and the average grain size d satisfying following Expression (1):

$$0.061 \leq [SF/\sqrt{d}] \leq 0.078 \quad (1).$$

10. A plate heat exchanger comprising the pure titanium sheet of claim 9 as a constituent.

11. The pure titanium sheet of claim 1, where the inevitable impurities are N: 0.03 percent by mass or less, C: 0.08 percent by mass or less, H: 0.013 percent by mass or less, Fe: 0.25 percent by mass or less, and O: 0.20 percent by mass or less.

12. A plate heat exchanger comprising the pure titanium sheet of claim 11 as a constituent.

13. The pure titanium sheet of claim 1, where the inevitable impurities are N: 0.05 percent by mass or less, C: 0.08 percent by mass or less, H: 0.013 percent by mass or less, Fe: 0.30 percent by mass or less, and O: 0.30 percent by mass or less.

14. A plate heat exchanger comprising the pure titanium sheet of claim 13 as a constituent.

15. The pure titanium sheet of claim 1, where the inevitable impurities are N: 0.03 percent by mass or less, C: 0.08 percent by mass or less, H: 0.015 percent by mass or less, Fe: 0.20 percent by mass or less, and O: 0.18 percent by mass or less.

16. A plate heat exchanger comprising the pure titanium sheet of claim 15 as a constituent.

17. The pure titanium sheet of claim 1, where the inevitable impurities are N: 0.03 percent by mass or less, C: 0.08 percent by mass or less, H: 0.015 percent by mass or less, Fe: 0.30 percent by mass or less, and O: 0.25 percent by mass or less.

18. A plate heat exchanger comprising the pure titanium sheet of claim 17 as a constituent.

* * * * *